US006323446B1

(12) United States Patent
Schnell

(10) Patent No.: US 6,323,446 B1
(45) Date of Patent: Nov. 27, 2001

(54) ROLLING BALL SWITCH

(75) Inventor: Robert J. Schnell, Plymouth, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/679,717

(22) Filed: Oct. 4, 2000

(51) Int. Cl.[7] ..... H01H 35/02
(52) U.S. Cl. ..... 200/61.52
(58) Field of Search ..... 73/514.01, 514.05, 73/514.06, 514.07, 514.35–514.37; 200/61.45 R–61.45 M

(56) References Cited

U.S. PATENT DOCUMENTS

| | | | |
|---|---|---|---|
| 5,136,127 | 8/1992 | Blair | 200/61.52 |
| 5,209,343 | 5/1993 | Romano et al. | 200/61.52 |
| 5,391,846 | 2/1995 | Taylor et al. | 200/233 |
| 5,478,978 | 12/1995 | Taylor et al. | 200/233 |
| 5,508,003 | 4/1996 | Rancourt et al. | 420/555 |
| 5,543,767 | 8/1996 | Elenbas | 335/205 |
| 5,751,074 | 5/1998 | Prior et al. | 307/118 |
| 5,792,236 | 8/1998 | Taylor et al. | 75/715 |

*Primary Examiner*—Michael Friedhofer
(74) *Attorney, Agent, or Firm*—John G. Shudy, Jr.

(57) ABSTRACT

Environmentally safe, non-mercury electronic switches having a sphere lubricated with an arc suppressant. Electronic tilt switches utilize an electrically conductive sphere and have good resistance to physical damage of the sphere caused by electrical arcing. A conductive sphere is coated with a lubricant that partially fills a hollow housing and prevents the electricity from pitting and corroding the ball.

25 Claims, 3 Drawing Sheets

ROLLING BALL SWITCH

BACKGROUND OF THE INVENTION

1. Field of the Invention

The invention relates to environmentally safe, non-mercury electronic switches. More particularly, the invention pertains to electronic tilt switches utilizing an electrically conductive sphere and having good resistance to physical damage of the sphere caused by electric arcing.

2. Description of the Related Art

The present invention relates to electronic devices, such as tilt switches that are alternately electrically turned "on" and "off" based on the position of a conductive sphere. A typical tilt switch comprises a hollow, enclosed housing or capsule having electrodes within the housing and extending through and outside the housing. Conventionally, a conductive material either in the form of a fluid, a weight or both is placed within the hollow housing. When using a fluid conductor, the housing is aligned in an "on" position when the conductive fluid electrically connects each of the electrodes, allowing the flow of electricity. The housing is aligned in an "off" position when the conductive fluid in the housing is tilted and does not electrically connect the electrodes, preventing the flow of electricity.

Traditionally, liquid mercury has been the preferred conductive material because it remains fluid at a wide range of temperatures, including room temperature. Also, mercury has been desirable because it has high surface tension, does not wet many surfaces that it contacts, and generally does not become damaged by contact with the electrodes. However, mercury, its vapor and its oxidized products are extremely toxic. Exposure to mercury has been known to cause disorders such as psychiatric problems in humans and disruption the endocrine systems of humans and animals. This has created a need in the art for a non-toxic alternative.

One commonly employed alternative has been to substitute a moveable conductive sphere for the liquid mercury. A typical tilt switches using a conductive sphere generally requires that the spherical conductor roll along a predefined path to alternately move from an electrically conductive position to an electrically nonconductive position. The conductive sphere is generally free moving and exhibits low rolling friction on an inclined surface. U.S. Pat. No. 5,136,127 teaches a tilt switch having at least one free moving spherical weight positioned in a housing that moves to an operating position when the weight is biased by gravity by inclination of the housing. However, conductive metal spheres have certain disadvantages. For example, conductive spheres are especially vulnerable to surface damage caused by electric arcing. When electrical current is made or broken by the spherical conductor moving into contact or out of contact with stationary conductors, or electrodes, it is common for arcing to occur. This arcing can create pitting on the surface of the sphere that may corrode the sphere and interfere with the smooth rolling of the sphere during later cycles of its operation.

U.S. Pat. No. 5,136,127 offers one solution to this problem, providing a tilt switch having first and second electrically conductive end caps, with each end cap having a non-conductive support edge, and a conductive sphere disposed in a space between the end caps. The sphere allows for the flow of electricity when positioned in contact with each of the conductive end caps, and will cut off electricity when the sphere is tilted out of electrical contact with the second end cap, contacting the non-conductive support edge of the second end cap. Any pitting of the sphere caused by arcing will not significantly interfere with rolling of the sphere because the sphere does not roll into and out of electrical contact with the conductive end caps, but tilts into and out of electrical contact with the end caps. However, pitting still interferes with electrical contact.

U.S. Pat. No. 5,209,343 offers another solution wherein a housing encapsulating the weight is filled with an inert atmosphere that will not react with the material of the weight to prevent pitting or other corrosion from forming on the weight that might adversely effect both the ability of the weight to move and the surface conductivity of the weight. Similarly, U.S. Pat. No. 5,543,767 teaches a tiltable switch wherein electrical arcing is prevented by filling a housing with an arc quenching gas such as argon or hydrogen, or by forming a vacuum in the housing.

One common problem with each of these existing tilt switches is the cost and complexity of manufacture and assembly which is often prohibitive in applications that require inexpensive switches to permit the application to be economically justifiable. The present invention offers a solution to the disadvantages of the related art.

The present invention provides a tiltable electrical device comprising a housing having electrodes extending from inside, through and outside the housing, at least one free moving electrically conductive sphere inside the housing and a lubricant at least partially filling the housing. The lubricant prevents electrical arcing from pitting the conductive sphere, eliminating corrosion of the sphere and maintaining its ability to freely roll and make good electrical contact. This device is an efficient and non-toxic replacement for conventional mercury switches. Further, the process provided by the invention requires no complex manufacturing steps and is a less expensive alternative than switches of the prior art.

SUMMARY OF THE INVENTION

The invention provides an electrical device comprising:

a) a closed, hollow housing having at least one electrode extending from inside, through and outside the housing; and b) at least one electrically conductive, lubricant coated sphere inside the housing, said sphere being moveable within said housing between a first position wherein said sphere is in electrical contact with at least two electrodes, and a second position wherein said sphere is not in electrical contact with at least two electrodes.

The invention also provides an electrical circuit comprising an electrically conductive pathway connected to an electrical device, which device comprises:

a) a closed, hollow housing having at least one electrode extending from inside, through and outside the housing;

b) at least one electrically conductive, lubricant coated sphere inside the housing, said sphere being moveable within said housing between a first position wherein said sphere is in electrical contact with at least two electrodes, and a second position wherein said sphere is not in electrical contact with at least two electrodes; and c) means for causing the conductive sphere to alternately electrically contact and electrically non-contact at least two electrodes;

wherein the electrically conductive pathway is electrically connected to at least one of said electrodes.

The invention further provides a process for producing an electrical device comprising:

a) placing an electrically conductive, lubricant coated sphere into a hollow housing, said housing having at least one electrode extending from inside, through and outside the housing, said sphere being moveable within said housing between a first position wherein said sphere is in electrical contact with at least two electrodes, and a second position wherein said sphere is not in electrical contact with at least two electrodes; and b) sealing the housing.

DETAILED DESCRIPTION OF THE PREFERRED EMBODIMENTS

The present invention relates to electronic devices that are alternately electrically turned "on" and "off" based on the position of an electrically conductive sphere or spheres inside an enclosed housing. The electronic devices provided by the invention have improved resistance to physical damage of the sphere or spheres caused by electrical arcing as compared to devices of the prior art.

Figure 2:
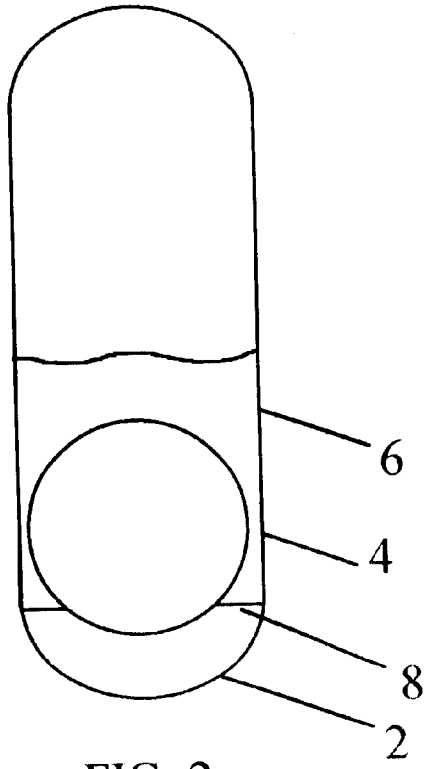
FIG. 2 is a schematic representation of a device having a plurality of electrodes extending into a housing and having an electrically conductive sphere inside it and where the housing is aligned so that the sphere is in electrical contact with the electrodes. This device is in the "on position".
Figure 3:
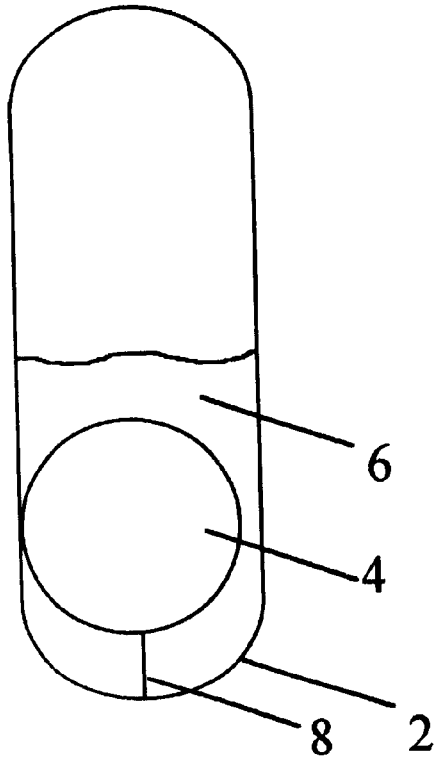
FIG. 3 is a schematic representation of a device wherein the housing is an electrode and a single electrode extends into the housing and having an electrically conductive sphere inside the housing and where the device is in the "on position".

At least one electrically conductive sphere 4 is placed inside a hollow housing or capsule 2 having at least one electrode 8 extending from inside, through and outside the housing the housing 2. This can be seen in the figures. In a preferred embodiment, only one electrode 8 physically extends inside the housing, while the housing itself comprises an electrode, allowing for the completion of a circuit. This embodiment can be seen in FIG. 3. In another preferred embodiment, a plurality of electrodes 8 physically extend inside the housing 2, irrespective of whether or not the housing comprises an electrode. This embodiment can be seen in FIG. 2.

The housing 2 is generally elongate and preferably is cylindrically shaped. The housing 2 comprises a hollow tube which is generally made of either plastic, ceramic material or glass. In another embodiment where the housing itself comprises an electrode, the housing is preferably made of a conductive material, such as ferrous steel. The housing may also be made of a nonmagnetic, electrically conductive material, such as copper, brass, aluminum or stainless steel when actuation of the device of the invention is to be conducted by magnetic flux.

The housing 2 is formed using well known techniques, such as with progressive dies or by using cylindrical or square stock cuts. The housing 2 is preferably circular in cross-section, but may also be square or rectangular in cross section.

Figure 1:
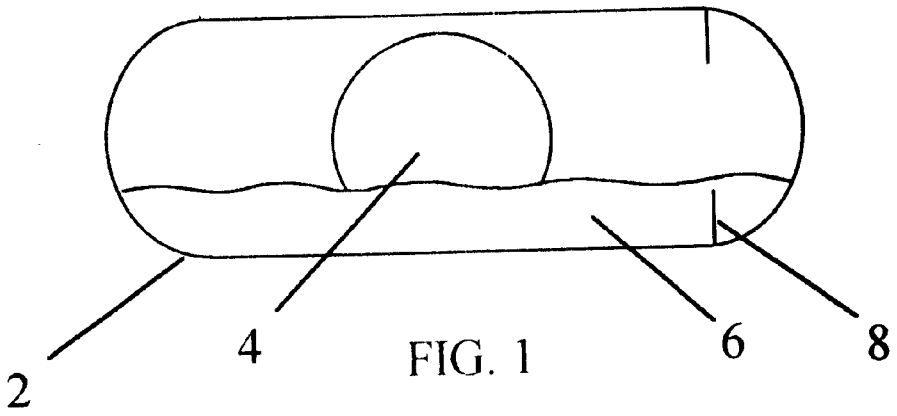
FIG. 1 is a schematic representation of a device having an enclosed, hollow housing having a lubricant coated, electrically conductive sphere inside it where the housing is aligned so that the sphere in electrical non-contact with two electrodes. This device is in the "off position".
Figure 4:
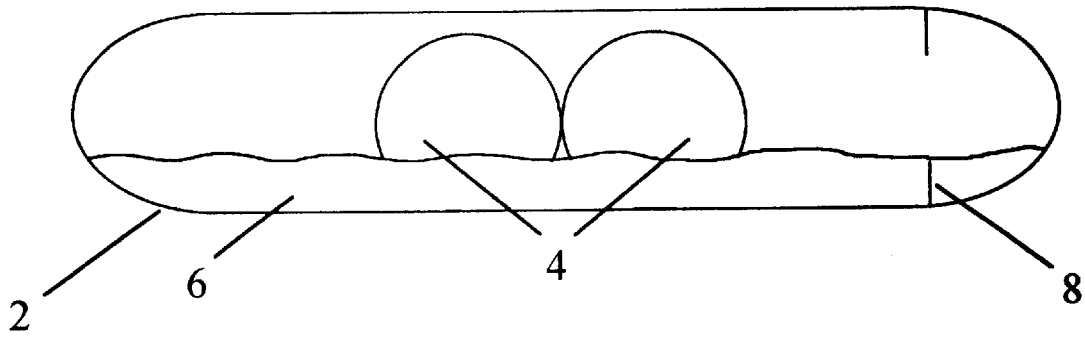
FIG. 4 is a schematic representation of a device having a plurality of lubricant coated, electrically conductive spheres inside the housing set in the "off position".
Figure 5:
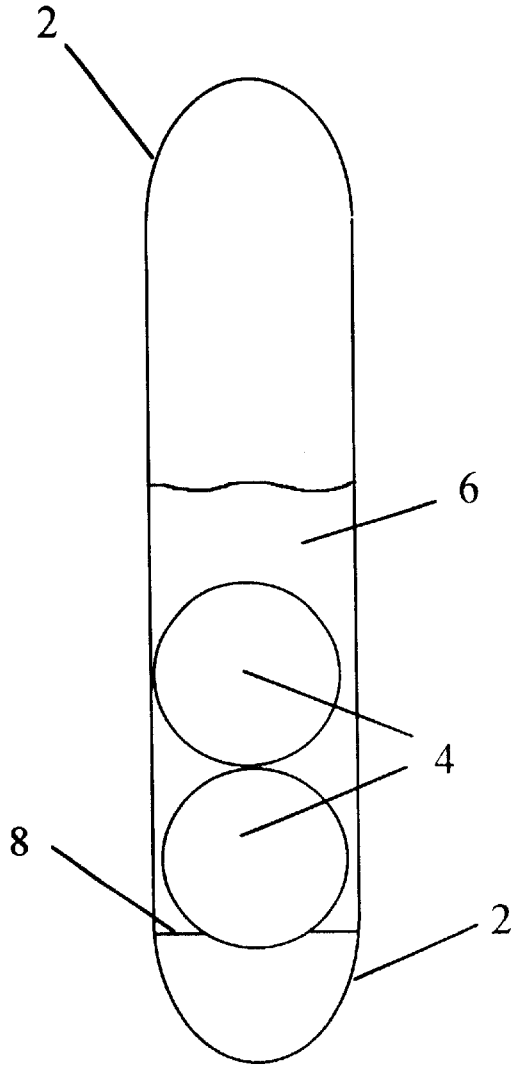
FIG. 5 is a schematic representation of a device having a plurality of lubricant coated, electrically conductive spheres inside the housing set in the "on position".
Figure 6:
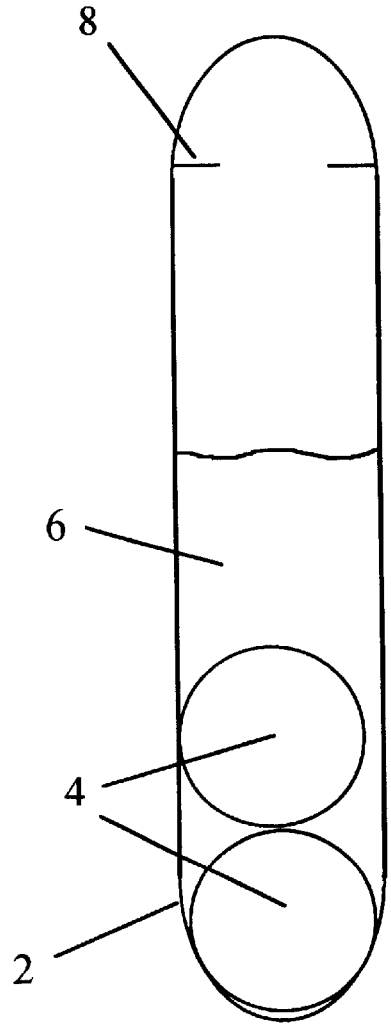
FIG. 6 is a schematic representation of a device having a plurality of lubricant coated, electrically conductive spheres inside the housing set in an alternate "off position".

Sealed inside the housing is at least one electrically conductive sphere 4. The conductive sphere is capable of moving freely within the housing in response to a change in attitude of the housing, between a first position wherein the sphere is in electrical contact with at least two electrodes, and a second position wherein the sphere is not in electrical contact with at least two electrodes. Examples of the first position can be seen in FIGS. 2, 3 and 5. Examples of the second position can be seen in FIGS. 1, 4 and 6.

The sphere 4 preferably comprises a material that is a good electrical conductor. Preferred materials non-exclusively include metals such as lead, steel, brass, copper, stainless steel and the like. The sphere may further include a plating such as nickel, silver or gold to increase surface conductivity. Most preferably the conductive sphere comprises stainless steel. However, if the device is to be actuated by a magnetic flux, the sphere 4 is made of an electrically conductive magnetic material, such as ferrous steel.

The sphere 4 may be solid metal or it may be hollow, but it is preferably solid. Alternately, the sphere 4 may comprise a non-conductive inner portion, such as a polymer, having an outer shell of a conductive metal. The preferred radius of the conductive sphere is of from about 1 mm or less to about 10 mm. More preferably, the radius of the sphere is of from about 3 mm to about 8 mm. The preferred weight of the sphere is of from about 0.5 g to about 2.0 g. More preferably, the sphere weighs from about 0.5 g to about 1.0 g. Alternatively the sphere may comprise a large plurality of small spheres, such that as a group they collectively make electrical contact with the electrodes.

Coating the sphere 4 and at least partially filling the housing is a liquid lubricant, i.e. an arc-suppressing fluid, 6, which may be a liquid or a gas. The preferred lubricant comprises a material having an extremely high dielectric constant, and preferably is a non-conductor. Additionally, the preferred lubricant is a material having a high heat capacity and high boiling point, suitable to absorb thermal energy from electrical arcing, and having low viscosity, allowing the conductive sphere to move smoothly and freely. It is also preferred that the lubricant 6 is non-corrosive and chemically inert to the sphere material. Suitable materials non-exclusively include methanol, methylene chloride, and fluorine containing compounds such as Fluorinert™ electronic liquids available from 3M™. Fluorinert™ liquids are particularly well suited for the purposes of this invention. They have unique properties which are characteristic of their fully fluorinated (perfluorinated) structures and their resulting intermolecular forces. These liquids are generally clear, colorless, odorless, and non-flammable.

The interior of the housing may optionally be partially filled with an atmosphere that is inert to conductive materials within the housing to protect the housing, conductive sphere and electrodes against corrosion and contamination, resulting in achievement of stable operating characteristics for a long period of time. Suitable inert gases non-exclusively include hydrogen, helium, argon and nitrogen. Alternatively, the housing may be placed under vacuum conditions to achieve similar results. The housing is then sealed using well known techniques.

Figure 7:
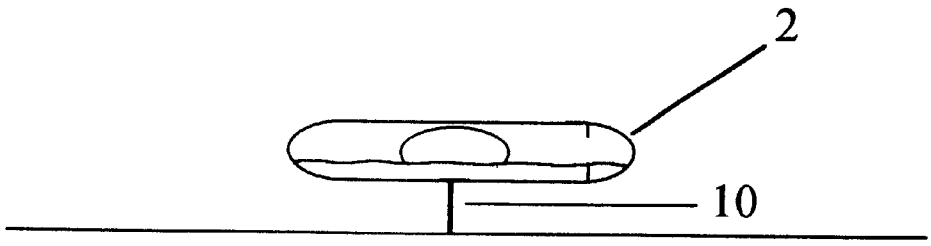
FIG. 7 is a schematic representation of the electronic device of the invention connected to a support via a pivot.
Figure 8:
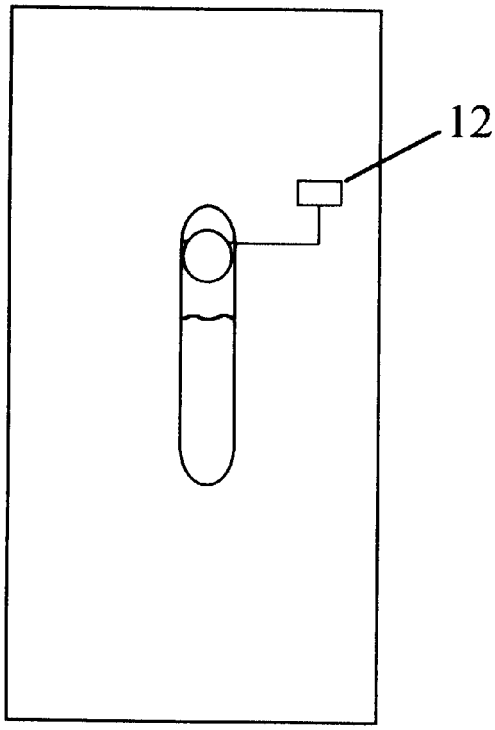
FIG. 8 is an overhead schematic representation of the device of the invention connected to a circuit and in the "on position".
Figure 9:
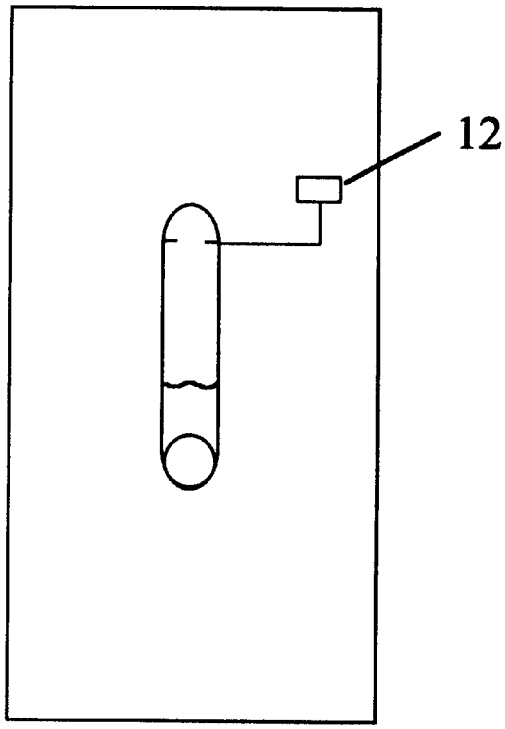
FIG. 9 is an overhead schematic representation of the device of the invention connected to a circuit and in the "off position".

The electrical device of the invention is preferably physically attached to a support as shown in FIG. 7. The device is preferably attached to the support via a pivot 10 along its central vertical axis. The pivot 10 also orients the attitude of the housing 2, causing the conductive sphere 4 to alternately roll from an "off position" as seen in FIG. 9, where the sphere is not contacting the electrodes, to an "on position" as seen in FIG. 8, where the sphere electrically connects at least two electrodes, allowing electricity to flow through the device. As seen in FIGS. 8 and 9, the device may be electrically connected to a circuit 12 or other electrical components through well known techniques such as by soldering or welding, forming an electrically conductive pathway. Attached to the electrical circuit 12 is a power supply (not shown). The circuit may be a member situated in various electronic equipment and systems, enabling the device of the invention to be used in multiple applications.

In use, the electrical device is generally capable of functioning as a tilt switch or a proximity switch. When functioning as a tilt switch, the sphere and housing are mechanically actuated using techniques well known in the art, allowing gravity to pull the sphere toward or away from the electrodes, thereby providing an alternately opened and closed electrical circuit between the sphere and electrodes.

When functioning as a proximity switch, the sphere and housing are actuated by a permanent magnet. By movement of the permanent magnet with respect to the housing, the sphere is selectively drawn toward or away from the electrodes, thereby causing the switch to function as a proximity switch. Also, an electromagnet wrapped with electric wires is provided adjacent to the housing. An electric current is provided to these wires using techniques that are well known in the are for selectively creating a magnetic flux. In this embodiment it is necessary that the electrically conductive sphere be comprised of a magnetic material, such as ferrous materials. Alternately, magnetism may be used to move a magnetic conductive sphere and tilt the housing, allowing the sphere to contact the electrodes.

In addition to the device of the present invention, the invention provides a process for producing an electrical device. In sum, the process comprises placing an electrically conductive, lubricant coated sphere into a hollow housing and sealing the housing.

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. An electrical device comprising:

a) a closed, hollow housing comprising at least two electrodes, wherein at least one of said electrodes extends from inside, through and outside the housing; and b) at least one electrically conductive, lubricant coated sphere inside the housing, the lubricant being an arc suppressant and at least partially filling the housing, said sphere being moveable within said housing between a first position wherein said sphere is in electrical contact with at least two of said electrodes, and a second position wherein said sphere is not in electrical contact with at least two of said electrodes.

2. The electrical device of claim 1 wherein the housing comprises on of said electrodes.

3. The electrical device of claim 1 wherein at least two of said electrodes extend from inside, through and outside the housing.

4. The electrical device of claim 1 wherein the conductive sphere comprises a metal selected from the group consisting of lead, steel, stainless steel, ferrous steel, brass, copper, nickel, silver, and gold.

5. The electrical device of claim 1 wherein the lubricant comprises a liquid material selected from the group consisting of methanol, methylene chloride and fluorine containing compounds.

6. The electrical device of claim 1 further comprising an atmosphere that is inert to conductive materials within the housing.

7. The electrical device of claim 1 wherein the inside of the sealed housing is under vacuum conditions.

8. The electrical device of claim 1 further comprising means for causing the conductive sphere to alternately electrically contact and electrically non-contact at least two of said electrodes.

9. The electrical device of claim 1 further comprising a pivot for orientation the attitude of the housing and causing the conductive sphere to alternately electrically contact and electrically non-contact at least two of said electrodes.

10. The electrical device of claim 1 further comprising a magnet for causing the conductive sphere to alternately electrically contact and electrically non-contact at least two electrodes.

11. The electrical device of claim 1 wherein the device is connected to a circuit.

12. An electrical circuit comprising the electrical device of claim 1.

13. An electrical circuit comprising an electrically conductive pathway connected to an electrical device, which device comprises:

a) a closed, hollow housing comprising at least two electrodes, wherein at least one of said electrodes extends from inside, through and outside the housing;

b) at least one electrically conductive lubricant coated sphere inside the housing, the lubricant being an arc suppressant and at least partially filling the housing, said sphere being moveable within said housing between a first position wherein said sphere is in electrical contact with at least two of said electrodes, and a second position wherein said sphere is not in electrical contact with at least two of said electrodes; and c) means for causing the conductive sphere to alternately electrically contact and electrically non-contact at least two of said electrodes; wherein the electrically conductive pathway is electrically connected to at least one of said electrodes.

14. The electrical circuit of claim 13 wherein the means for causing comprises a pivot for orienting the attitude of the housing.

15. The electrical circuit of claim 13 wherein means the means for causing comprises a magnet.

16. The electrical circuit of claim 13 wherein the housing comprises one of said electrodes.

17. The electrical circuit of claim 13 wherein at least two of the electrodes extend from inside, through and outside the housing.

18. The electrical circuit of claim 13 wherein the conductive sphere comprises a metal selected from the group consisting of lead, steel, stainless steel, ferrous steel, brass, copper, nickel, silver and gold.

19. The electrical circuit of claim 13 wherein the lubricant comprises a liquid material selected from the group consisting of methanol, methylene chloride, and fluorine containing compounds.

20. The electrical circuit of claim 13 wherein the housing further comprises an atmosphere that is inert to conductive materials.

21. The electrical circuit of claim 13 wherein the inside of the sealed housing is under vacuum conditions.

22. A process for producing an electrical device comprising:

a) placing an electrically conductive, lubricant coated sphere into a hollow housing, the lubricant being an arc suppressant and at least partially filling the housing, said housing comprising at least two electrodes, wherein at least one of said electrodes extends from inside, through and outside the housing, said sphere being moveable within said housing between a first position wherein said sphere is in electrical contact with at least two of said electrodes, and a second position wherein said sphere is not in electrical contact with at least two of said electrodes; and b) sealing the housing.

23. The process of claim 22 further comprising filling the housing with an inert gas prior to sealing.

24. The process of claim 22 further comprising applying a vacuum to the inside of the housing prior to sealing.

25. The process of claim 22 further comprising attaching the housing to a pivot for orienting the attitude of the housing and causing the conductive sphere to alternately electrically contact and electrically non-contact at least two of said electrodes.

* * * * *